US007690055B2

(12) United States Patent
Hammer et al.

(10) Patent No.: US 7,690,055 B2
(45) Date of Patent: Apr. 6, 2010

(54) BATH TRANSFER SYSTEM

(75) Inventors: Bruce R. Hammer, San Rafael, CA (US); Davey S. Ijams, Richmond, CA (US)

(73) Assignee: Nuprodx, Inc., San Rafael, CA (US)

( * ) Notice: Subject to any disclaimer, the term of this patent is extended or adjusted under 35 U.S.C. 154(b) by 1021 days.

(21) Appl. No.: 11/407,626

(22) Filed: Apr. 20, 2006

(65) Prior Publication Data

US 2006/0236449 A1 Oct. 26, 2006

Related U.S. Application Data

(60) Provisional application No. 60/673,173, filed on Apr. 20, 2005.

(51) Int. Cl.
*A47K 3/02* (2006.01)

(52) U.S. Cl. ..... 4/560.1

(58) Field of Classification Search ..... 4/560.1–563.1, 4/578.1

See application file for complete search history.

(56) References Cited

U.S. PATENT DOCUMENTS 5,373,591 A * 12/1994 Myers ..... 4/560.1
5,517,704 A * 5/1996 Dagostino ..... 4/560.1
7,506,385 B2 * 3/2009 Werschmidt ..... 4/561.1

* cited by examiner

*Primary Examiner*—Huyen Le
(74) *Attorney, Agent, or Firm*—Richard D. Clarke

(57) ABSTRACT

The present invention involves a new and improved stable and portable bath transfer system that provides a disabled person complete access to bathroom facilities without having to transfer apparatus. The invention comprises a chair portion, a connector bridge portion, and a bathtub portion. The chair portion includes a base section with two or more support members and an upper chassis section including an adjustable backrest, a collapsible chair seat, and two swing-away armrests. The connector bridge portion includes connecting members attached by a cross member. The bathtub portion includes a base and four adjustable support members that provide increased stability and fine adjustment capability to match the chair portion height. The bath transfer system includes an interlocking system containing a continuous groove and lipped brackets to prevent the upper chassis section from tipping or lifting, and anti-roll mechanisms and a volitional latch to prevent undesired sliding of the upper chassis.

19 Claims, 8 Drawing Sheets

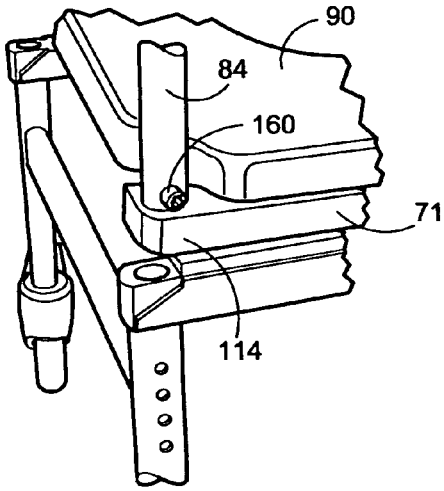
FIG. 10A
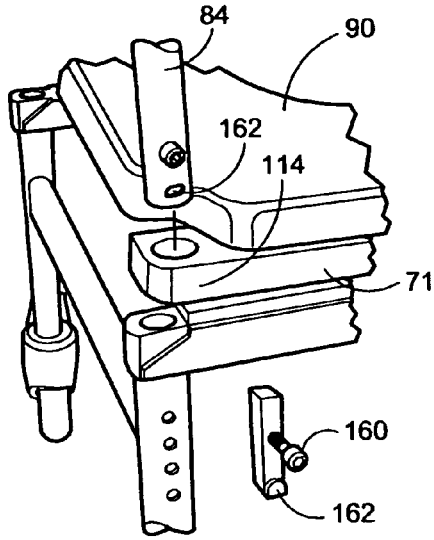
FIG. 10B
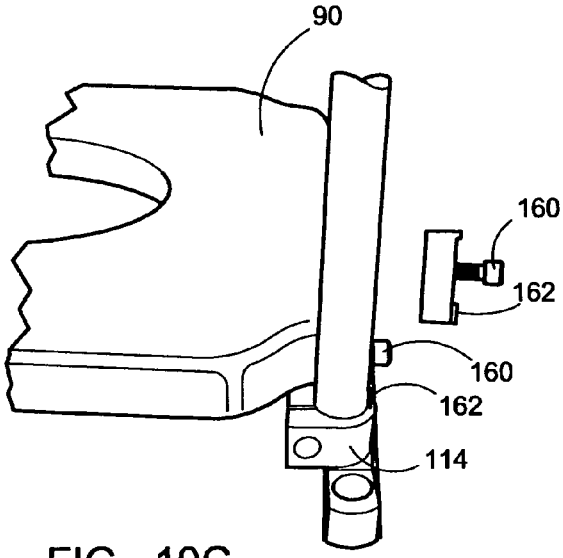
FIG. 10C
FIG. 10D
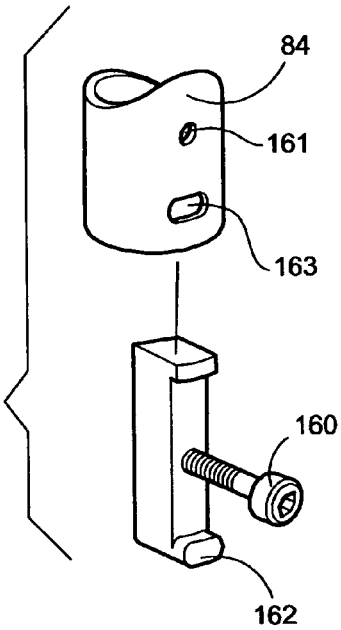

BATH TRANSFER SYSTEM

This application claims the benefit of previously filed U.S. provisional patent application Ser. No. 60/673,173, filed on Apr. 20, 2005.

FIELD OF THE INVENTION

This invention relates to the field of shower and commode apparatus. More specifically, this patent deals with a new and improved portable bath transfer system designed to allow a person with a disability to have complete access to bathroom facilities without having to transfer from one apparatus to another apparatus.

BACKGROUND OF THE INVENTION

Caring for a disabled person requires assisting the person in using the bathroom, including the toilet and shower. Several devices have been developed and are well-known in the art that enable the transfer of a person into the bathroom and provide them the ability to use the toilet. Different devices have been developed and are well known in the art that allow a person to be transferred into the shower or bathtub. However, if in the same trip to the bathroom the use of the toilet and the shower is desired, a change in transfer device is often needed, which requires heavy lifting of the person out of the old device and into the new device.

Few devices have been developed to allow for the seamless transition from bed to toilet to shower or bathtub. These apparatus are typically comprised of a commode chair with a seat that can slide along an adjoining track system, over the barrier of the shower or bathtub, to position the person over the shower or bathtub. The track systems employed have either been fixed to the shower or bathtub or have been supported on one side by the commode chair and on the other side by two support members. Fixation of the track system to the shower or bathtub does not enable the track system to be transported to another location. Reliance on the commode chair to support the track system can present stability problems during the transfer, which can result in injury to the person transferred.

A further problem encountered in the prior art apparatus during the transfer from toilet to shower or bathtub relates to the adjustability of the track system support members. Most homes contain standard showers or bathtubs that do not provide wheelchair or commode chair roll-in capability. The bottom of these traditional showers and bathtubs do not often sit on the same level as the floor of the bathroom. To remedy this problem, apparatus utilizing the track system contain adjustable support members. The support members generally are adjustable at fixed intervals using a conventional ball and detent system. If the fixed interval adjustment does not allow for adjustment to match the precise height differential between the shower or bathtub and the bathroom floor, unevenness and tilting of the track system can result, causing unexpected sliding of the seat portion.

Another problem encountered in the prior art apparatus involves the lack of a locking mechanism to secure the seat portion once the person is positioned over the shower or bathtub. Combined with a lack of evenness in the track system caused by the inability to finely adjust the height of the track system support members, the lack of a seat portion securing mechanism further increases the risk that during a shower or bath an unsupervised person will slide out of the bathtub or shower region, causing serious injury.

A further limitation of the prior art apparatus is the inability to easily transport the apparatus from location to location. Apparatus that utilize a track system mounted on the bathtub do not provide easy portability, as the track system must be removed from the bathtub and cannot be collapsed. Additionally, most apparatus contain commode chairs that cannot be collapsed for easy transport. Non-portability forces a user to purchase additional transfer systems, resulting in greater expense to the user.

Prior art bath transfer apparatus also do not provide the option for a person to shower or bathe in complete privacy. Apparatus utilizing the commode chair to support one side of the track system do not allow for the shower or bathtub curtain to be fully closed around the person bathing. While apparatus utilizing a track system fixed to the bathtub provide complete privacy, they do not provide portability or the ability for others to utilize the bathtub or shower without having to remove the track system.

Thus, it would be highly desirable to provide a strong, portable, stable, and convenient bath transfer system that allows a person with a disability to have complete access to bathroom facilities without having to transfer apparatus.

In this respect, before explaining at least one embodiment of the invention in detail it is to be understood that the invention is not limited in its application to the details of construction and to the arrangement of the components set forth in the following description or illustrated in the drawings. The invention is capable of other embodiments and of being practiced and carried out in various ways. In addition, it is to be understood that the phraseology and terminology employed herein are for the purpose of description and should not be regarded as limiting.

SUMMARY OF THE INVENTION

The present invention involves a new and improved stable and portable bath transfer system that provides a disabled person complete access to bathroom facilities without having to transfer from one apparatus to another apparatus. The invention comprises a chair portion, a connector bridge portion, and a bathtub portion. The chair portion includes a base section with two or more support members and an upper chassis section including an adjustable backrest, a collapsible chair seat, and two swing-away armrests. The connector bridge portion includes connecting members attached by a cross member. The bathtub portion includes a base and four adjustable support members that provide increased stability and fine adjustment capability to match the chair portion height. The bath transfer system includes an interlocking system containing a continuous groove and wheel and lipped brackets to prevent the upper chassis section from tipping or lifting, and anti-roll mechanisms and a volitional latch to prevent undesired sliding of the upper chassis.

An alternative embodiment of the present invention involves a new and improved stable and portable bath transfer system that provides a disabled person complete access to bathroom facilities, including the ability to soak in a bathtub, without having to transfer from one apparatus to another apparatus. The invention comprises a chair portion, a connector bridge portion, and a bathtub portion. The chair portion includes a base section with two or more support members and an upper chassis section including an adjustable backrest, a collapsible chair seat, and two swing-away armrests. The connector bridge portion includes connecting members attached by a cross member. The bathtub portion includes a base, one or more support members, and means for lowering the upper chassis into the bathtub. Such means for lowering the upper chassis into the bathtub can be an electrical, pneumatic, hydraulic powered motor, or mechanical means such as a hand crank. The bath transfer system includes an interlocking system containing a continuous groove and wheel and lipped brackets to prevent the upper chassis section from tipping or lifting, and anti-roll mechanisms and a volitional latch to prevent undesired sliding of the upper chassis.

With respect to the above description it is to be realized that the optimum dimensional relationships for the parts of the invention, including variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents fall within the scope of the present invention.

These advantages, together with other advantages of the invention, along with the various features of novelty, which characterize the invention, are pointed out with particularity in the claims annexed to and forming a part of this disclosure. For a better understanding of the invention, its operating advantages and the specific advantages attained by its uses, reference should be made to the accompanying drawings and descriptive matter in which there are illustrated preferred embodiments of the invention. There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

BRIEF DESCRIPTION OF THE DRAWINGS

The accompanying drawings, which are incorporated in and form a part of this specification, illustrate embodiments of the invention and together with the description, serve to explain the principals of this invention.

FIG. 10A depicts a perspective view of the internal clamp lever arm disposed within the upper chassis and backrest support member, constructed in accordance with the present invention;

FIG. 10B depicts a perspective view of the internal clamp lever arm both disposed within the upper chassis and backrest support member, and standing freely outside the upper chassis and backrest support member, constructed in accordance with the present invention;

FIG. 10C depicts a side view of the internal clamp lever arm both disposed within the upper chassis and backrest support member, and standing freely outside the upper chassis and backrest support member, constructed in accordance with the present invention;

FIG. 10D depicts the orifices found in the base of the backrest support member and their relationship to the internal clamp lever arm and the lever arm portion;

DETAILED DESCRIPTION OF THE PREFERRED EMBODIMENTS

Figure 1:
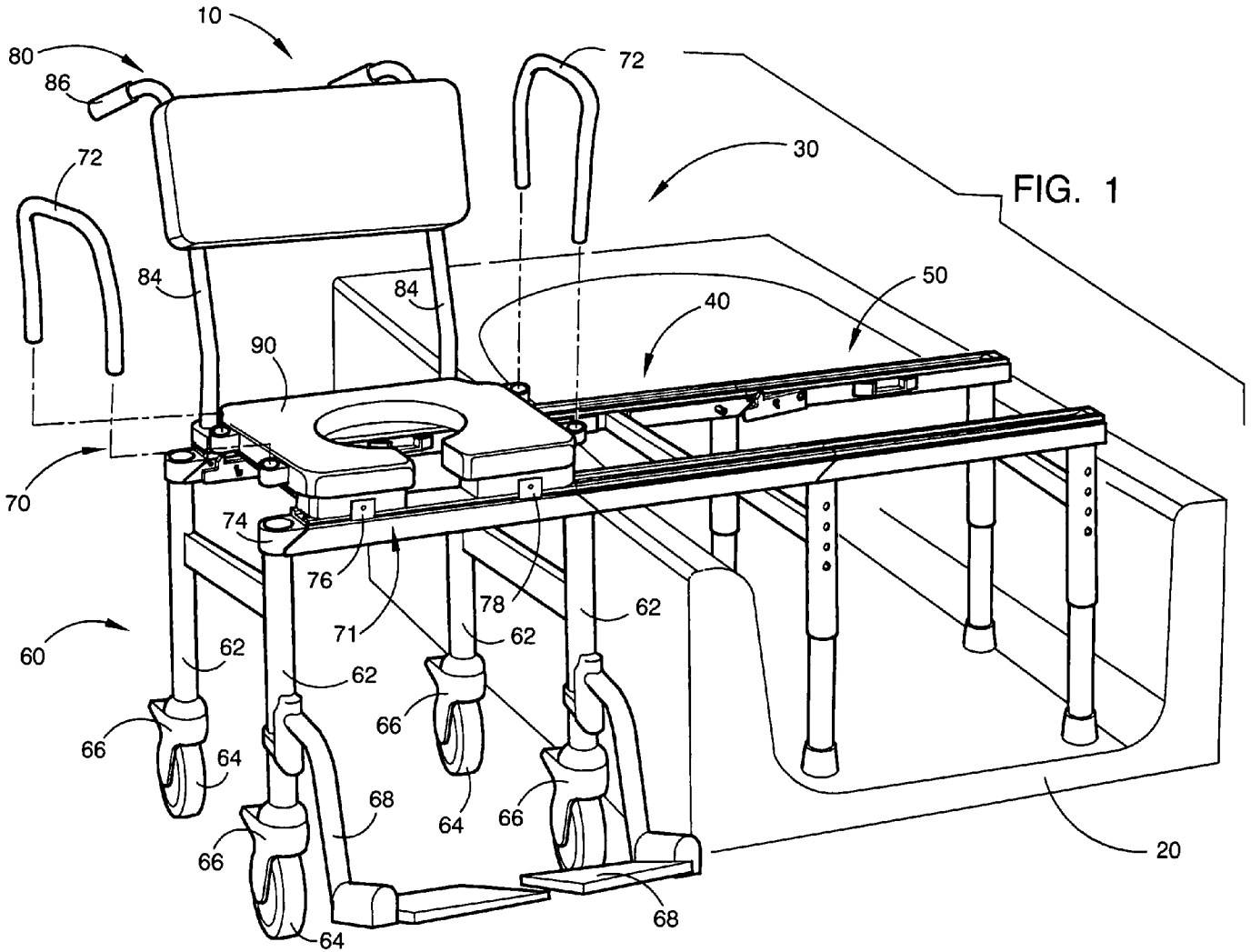
FIG. 1 depicts a perspective view of the preferred embodiment of the bath transfer system in position adjacent to a bathtub, including the chair portion, connector bridge portion, and bathtub portion located within the bathtub, constructed in accordance with the present invention.

Referring now to the drawings, wherein similar parts are identified by like reference numerals, there is seen in FIG. 1 a perspective view of the preferred embodiment of the bath transfer system 10 in position adjacent to a bathtub 20. Bath transfer system 10 includes a chair portion 30, a connector bridge portion 40, and a bathtub portion 50. Chair portion 30 is comprised of a base portion 60 and an upper portion 70. Base component 60 includes base component legs 62, base component wheels 64 attached to each base component leg 62, base component wheel housing 66 attached to each base component leg 62, and base component footrest assembly 68 attached to two base component legs 62. Upper portion 70 includes upper chassis 71, swing-away locking arms 72, swing-away locking arm attachment fitting 74, backrest portion 80, and chair seat 90. The upper chassis houses and protects the wheel roller mechanisms 76 and 78. Backrest portion 80 includes backrest support 82, backrest support members 84, and backrest support push handles 86.

Figures 2, 2A:
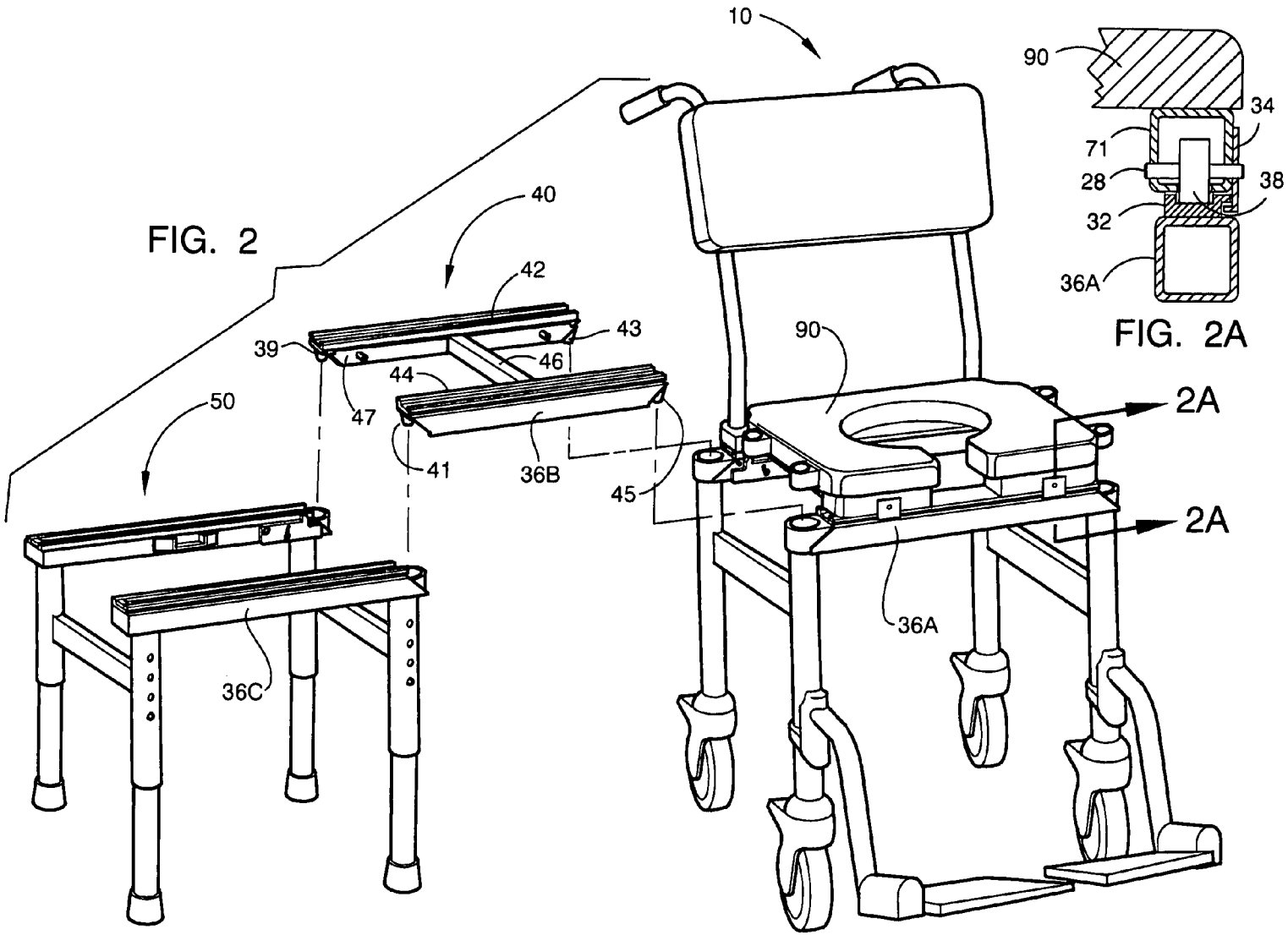
FIG. 2 depicts a perspective view of the preferred embodiment of the bath transfer system with the connector bridge portion detached, illustrating by arrows how the connector bridge portion attaches to the chair portion and the bathtub portion, constructed in accordance with the present invention.
FIG. 2A depicts a cross-sectional view of the wheel, wheel axle and securing bracket assembly, constructed in accordance with the present invention.

As illustrated in FIG. 2, there is seen a perspective view of the preferred embodiment of the bath transfer system 10 with connector bridge portion 40 detached, illustrating by arrows how connector bridge portion 40 attaches to chair portion 30 and bathtub portion 50. Each portion has a frame member associated with it, that is, frame member 36A is associated with the chair portion 30, frame member 36B is associated with the bridge portion 40, and frame member 36C is associated with bathtub portion 50. Connector bridge portion 40 is comprised of track member 42, track member 44, cross-member 46, and two or more latch slides 47. Cross-member 46 is coupled on one end to track member 42 and on the other end to track member 44. Cross-member 46 can either be comprised of a standard metal frame rod, or a telescoping portion to enable greater collapsibility. Conically shaped cleats 39, 41, 43 and 45 attached to frame member 36B, fit into the chair portion 30 supports and the bathtub portion 50 supports, and removeably but firmly secure the connector bridge 40 to the chair and bathtub portions. It is to be recognized that connector bridge portion 40 can be constructed of rust corrosion and preventative material, including but not limited to aircraft grade aluminum, stainless steel, and plastic.

As illustrated in FIG. 2A, there is seen a cross-sectional view of the lipped wheel track 32, wheel 38, wheel axle 28 and securing bracket 34 in relation to the upper chassis 71. To secure the chair portion from tipping or the wheel 38 from coming off the track, securing bracket 34 partially wraps around the lipped wheel track 32. All of the rolling wheel mechanism is protectively housed within upper chassis 71, with the wheel axle 28 visible on the outside, and the lipped wheel track rests on frame member 36 (here 36A that portion of the frame member associated with the chair portion). These wheel assemblies are a single removable unit, therefore, wheels are easily replaced when worn.

Figure 3:
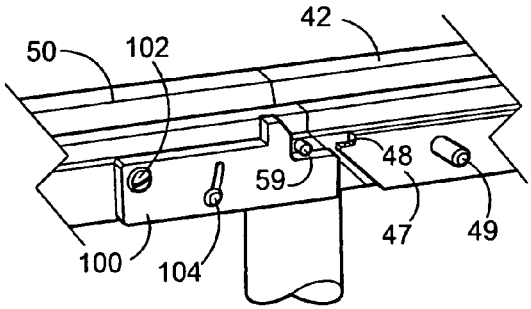
FIG. 3 depicts a perspective view of an anti-roll latch on the bathtub portion not engaged with the connector bridge portion, constructed in accordance with the present invention.

As illustrated in FIG. 3, there is seen a perspective view of anti-roll latch 100 on bathtub portion 50. Bathtub portion 50 contains two or more anti-roll latches 100. Anti-roll latch 100 is shown coupled to bathtub portion 50 by pivot 102 and screw 104, but it is to be recognized that anti-roll latch 100 can be coupled to bathtub portion 50 by other means as known and apparent in the art, as well as can be incorporated into the design of bathtub portion 50. As shown, anti-roll latch 100 is not engaged with latch slide 47, preventing upper chassis 71 (shown in FIG. 1) from sliding along track member 42. Latch slide 47 contains a pin accepting portion 48. Pin accepting portion 48 serves to engage or disengage pin 59 on bathtub portion 50 to prevent or allow track member 42 from lifting and separating from bathtub portion 50 and track member 44 (shown in FIG. 2). As shown, pin accepting portion 48 is not engaged with pin 59 on bathtub portion 50, allowing track member 42 to be lifted upward and separated from bathtub portion 50. Latch slide knob 49 is used to slidably translate latch slide 47 to engage with anti-roll latch 100.

Figure 4:
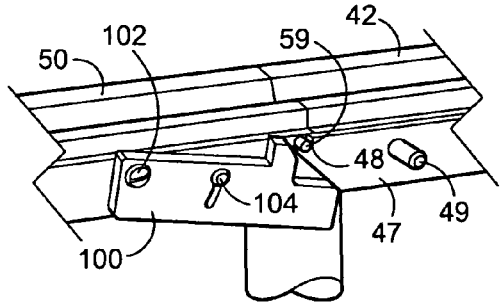
FIG. 4 depicts a perspective view of an anti-roll latch on the bathtub portion engaged with the connector bridge portion, constructed in accordance with the present invention.

As illustrated in FIG. 4, there is seen a perspective view of an anti-roll latch 100 on bathtub portion 50. Anti-roll latch 100 is shown coupled to bathtub portion 50 by pivot 102 and screw 104, but it is to be recognized that anti-roll latch 100 can be coupled to bathtub portion 50 by other means as known in the art, as well as be incorporated into the design of bathtub portion 50. As shown, anti-roll latch 100 is engaged with latch slide 47, allowing upper chassis 71 (shown in FIG. 1) to slide along track member 42. Also, pin accepting portion 48 has engaged pin 59 on bathtub portion 50, preventing track member 42 from lifting and separating from bathtub portion 50. Latch slide knob 49 is used to slidably translate latch slide 47 to engage with anti-roll latch 100.

Figure 5:
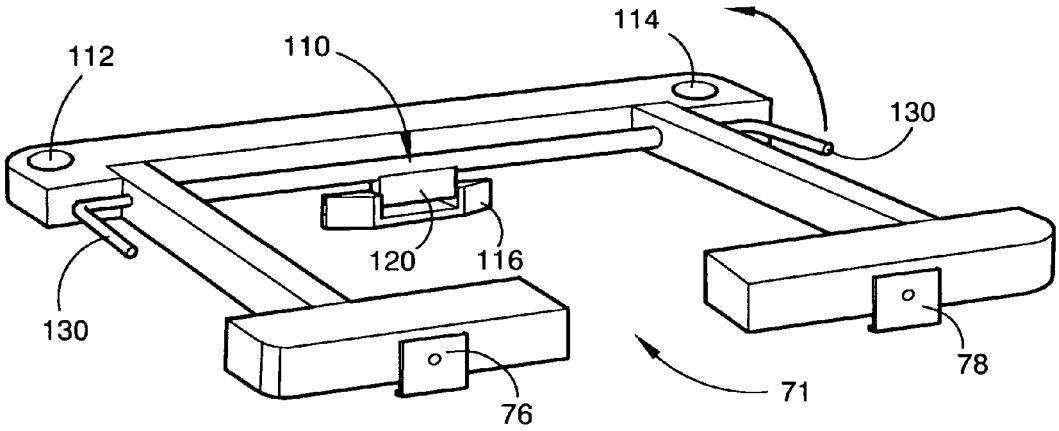
FIG. 5 depicts a perspective view of the manual latch in relation to the upper chassis of the chair portion, constructed in accordance with the present invention.

As illustrated in FIG. 5, there is seen a perspective view of manual latch 110 in relation to upper chassis 71, backrest support member receiving member 112, and backrest support member receiving member 114. Backrest support member receiving member 112 and backrest support member receiving member 114 are permanently joined to upper chassis 71. Manual latch 110 includes one or more engagement ramps 116 attached to base component 60 (as shown in FIG. 1), continuous rod 118, flap 120, and lever handles 130. Engagement ramps 116 can be permanently or removably attached to base component 60. When engaged, manual latch 110 prevents upper chassis 71 from slidably translating with respect to base component 60.

Figure 6:
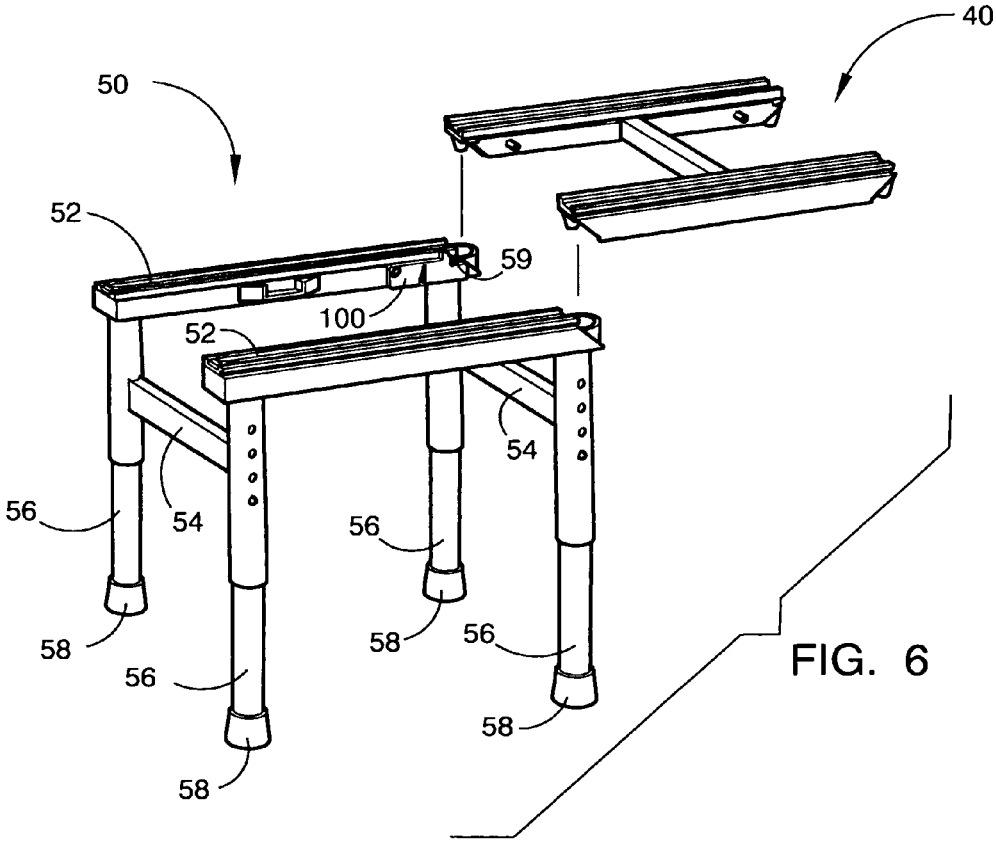
FIG. 6 depicts a perspective view of the bathtub portion of the preferred embodiment of the bath transfer system with the connector bridge portion detached, illustrating with arrows how the connector bridge portion is attached to the bathtub portion, constructed in accordance with the present invention.

As illustrated in FIG. 6, there is a perspective view of bathtub portion 50 of the preferred embodiment of bath transfer system 10 with connector bridge portion 40 detached, illustrating by arrows how connector bridge portion 40 is connected to bathtub portion 50. Bathtub portion 50 includes bathtub track members 52, bathtub cross-members 54, bathtub support members 56, bathtub support stabilizers 58, and pin 59. Bathtub support stabilizers 58 are attached to the bottom of bathtub support members 56 to prevent slippage of bathtub portion 50 during use. An anti-roll latch 100 can be attached to one end of each of bathtub track members 52. Pin 59 serves to engage or disengage with latch slide 48 to prevent or allow track member 42 and track member 44 (both shown in FIG. 2) from lifting. It is to be recognized that bathtub portion 50 can be constructed rust corrosion and preventative material, including but not limited to aircraft grade aluminum, stainless steel, and plastic.

Figure 7:
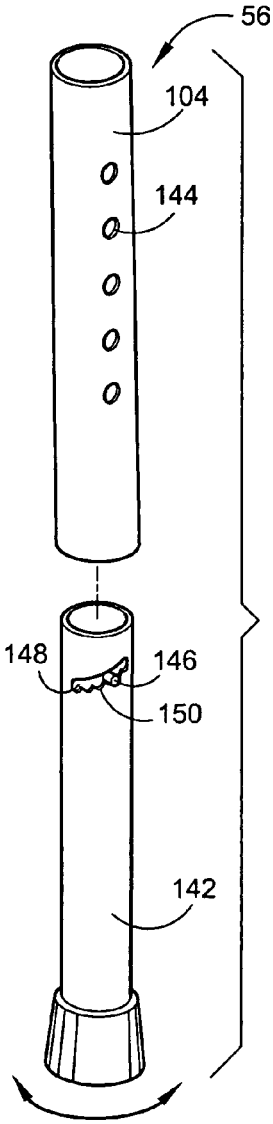
FIG. 7 depicts a perspective view of a support member of the bathtub portion, with the outer tubular member separated from the inner tubular member, constructed in accordance with the present invention.

As illustrated in FIG. 7, there is shown a perspective view of bathtub support member 56 with outer tubular member 140 separated from inner tubular member 142. Outer tubular member 140 contains a plurality of orifices 144 through which a conventional spring-loaded plunger 146 can be disposed. The plurality of orifices 144 are spaced apart at equal lengths and provide for a gross adjustment of the height of bathtub portion 50 (not shown). Plurality of orifices 144 can be spaced apart at a distance ranging from 0.50 inches to 1.0 inches. Inner tubular member 142 contains a helical slot 148 with detents 150, through which spring loaded plunger 146 can be disposed. Helical slot 148 is diagonally positioned on inner tubular member 142, such that, when inner tubular member 142 is rotated about its central axis, spring loaded plunger 146 will engage in a different detent 150, and thus raising or lowering bathtub support member 56 depending on the direction of rotation. A user can rotate inner tubular member 142 in the direction of the arrow shown to finely adjust the height of bathtub support member 56 to ensure that bath transfer system 10 is not unevenly situated.

Figure 8:
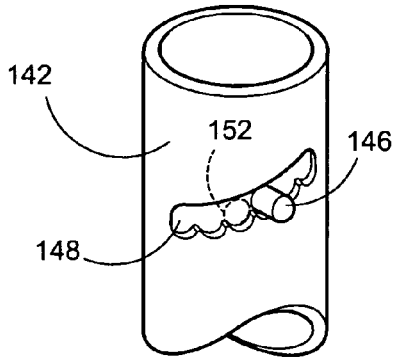
FIG. 8 depicts an enlarged detailed view of the fine adjustment mechanism of the support member of the bathtub portion, constructed in accordance with the present invention.

As illustrated in FIG. 8, there is an enlarged detailed view of helical slot 148, with spring-loaded plunger 146 disposed through a detent 150. An incremental height adjustment is caused by the rotation of inner tubular member 142 from the shifting of one detent 150 to another detent 152. This distance can vary depending on the number and size of detents 150, as well as the vertical slope of helical slot 148. For example, the distance can range from 0.060 inches to 0.250 inches, which means for each click-stop the change in height is up or down 0.060 inches to 0.250 inches. This makes fine height adjustments readily attainable.

Figure 8A:
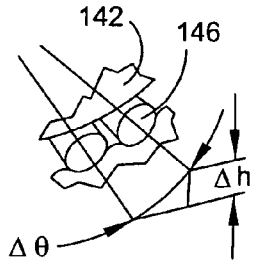
FIG. 8A depicts a radial rise over run theory diagram illustrating the theta angle and the change in height proportional to the arc run.

Referring now to FIG. 8A, there is seen a theoretical diagram of the rise over run proportions for the fine height adjustments realized with the present invention. As the spring-loaded plunger 146 arcs though space in a changing angle from center, here illustrated as angle theta (θ) there is a proportional change in height (Δh).

Figure 9:
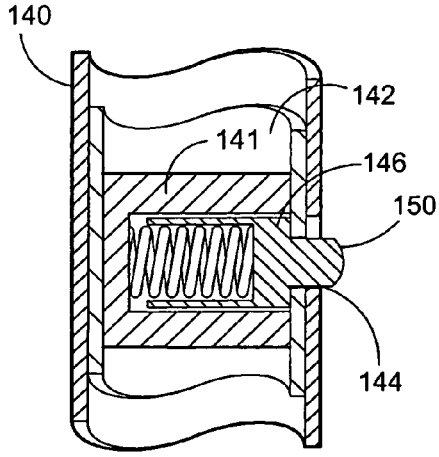
FIG. 9 depicts a side view of a vertical cross-section of a spring-loaded plunger disposed within a support member of the bathtub portion, constructed in accordance with the present invention.

As illustrated in FIG. 9, there is depicted a side view of a vertical cross-section of spring-loaded plunger 146 disposed within inner tubular member 142 and outer tubular member 140, and through both one of plurality of orifice 144 and detent 150.

As illustrated in FIG. 10A, there is depicted a perspective view of internal clamp lever arm 160 fully disposed within backrest support member receiving member 114 and backrest support member 84.

As illustrated in FIG. 10B, there is depicted a perspective view of internal clamp lever arm 160 containing lever arm portion 162, partially disposed within backrest support member receiving member 114 and fully disposed within backrest support member 84, and standing freely outside backrest support member receiving member 114 and backrest support member 84.

As illustrated in FIG. 10C, there is depicted a side view of internal clamp lever arm 160 containing lever arm portion 162, partially disposed within backrest support member receiving member 114 and fully disposed within backrest support member 84, and standing freely outside backrest support member receiving member 114 and backrest support member 84.

Referring now to FIG. 10D there is shown a lower end of the backrest support member clearly illustrating the orifices 161 and 163 there through. Orifice 161 accepts the threaded portion of internal clamp lever arm 160, and orifice 163 accepts the lever arm portion 162. In this way, there exists an important redundant securing system for stabilizing the chair from tipping and preventing the chair back from unexpectedly detaching or collapsing.

Figure 11A:
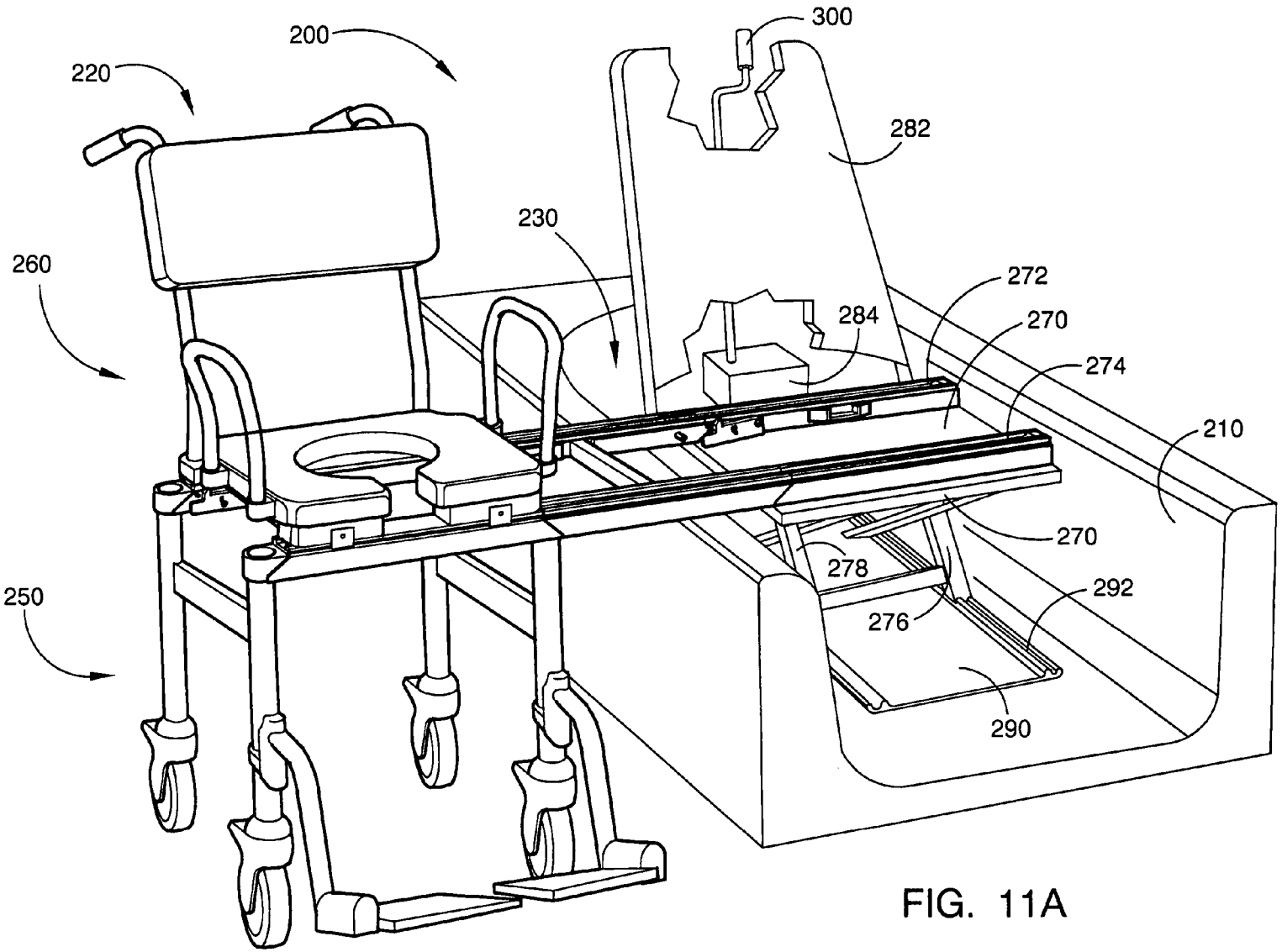
FIG. 11A depicts a perspective view of an alternate embodiment of the bath transfer system with the capability to lower and raise an individual into and out of a bathtub, with the upper portion positioned over the base portion, constructed in accordance with the present invention.

Referring now to FIG. 11A, there is seen a perspective view an alternate embodiment of the bath transfer system 200 in position adjacent to a bathtub 210. Bath transfer system 200 comprises a chair portion 220, a connector bridge portion 230, and a bathtub portion 240. Chair portion 220 includes a base portion 250 and an upper portion 260. Base portion 250 contains similar elements and is constructed similarly to base portion 60 of bathtub transfer system 10. Upper portion 260 contains similar elements and is constructed similarly to upper portion 70 of bathtub transfer system 10. Connector bridge portion 230 contains similar elements and is constructed similarly to connector bridge portion 40 of bathtub transfer system 10. It is to be recognized that connector bridge portion 230 can be constructed of rust corrosion and preventative material, including but not limited to aircraft grade aluminum, stainless steel, and plastic. As shown, upper portion 260 is positioned over base portion 250.

As illustrated in FIG. 11A, there is seen a perspective view of bathtub portion 240 of bath transfer system 200, with connector bridge portion 230 connected to bathtub portion 240 and upper portion 260 positioned over base portion 250. Bathtub portion 240 includes a base section 270, a backrest section 280, a stabilizing mechanism 290, and a lowering mechanism 300. Base section 270 includes base track member 272, base track member 274, base support member 276, and base support member 278. Base track member 272 and base track member 274 are attached to base section 270 by conventionally recognized methods. Backrest section 280 includes backrest support 282 and reclining mechanism 284. Base support member 276 and base support member 278 are connected to stabilizing mechanism 290 to provide traction and support for bathtub portion 240 within bathtub 210. Stabilizing mechanism 290 can contain a plurality of grooves 292 to allow for the controlled lowering or raising of base section 270 and upper portion 260. Lowering mechanism 300 is located behind backrest section 280. Lowering mechanism 300 can be comprised of an electrical, pneumatic, or hydraulic powered motor or a mechanically operated mechanism such as a hand crank. Lowering mechanism 300 can be used to turn a screw shaft to raise or lower upper portion 260, such raising or lowering is accomplished by base support member 276 and base support member 278 functioning in a scissor-like manner with respect to stabilizing section 290. It is to be recognized that bathtub portion 240 can be constructed rust corrosion and preventative material, including but not limited to aircraft grade aluminum, stainless steel, and fiber-reinforced plastic.

Figure 11B:
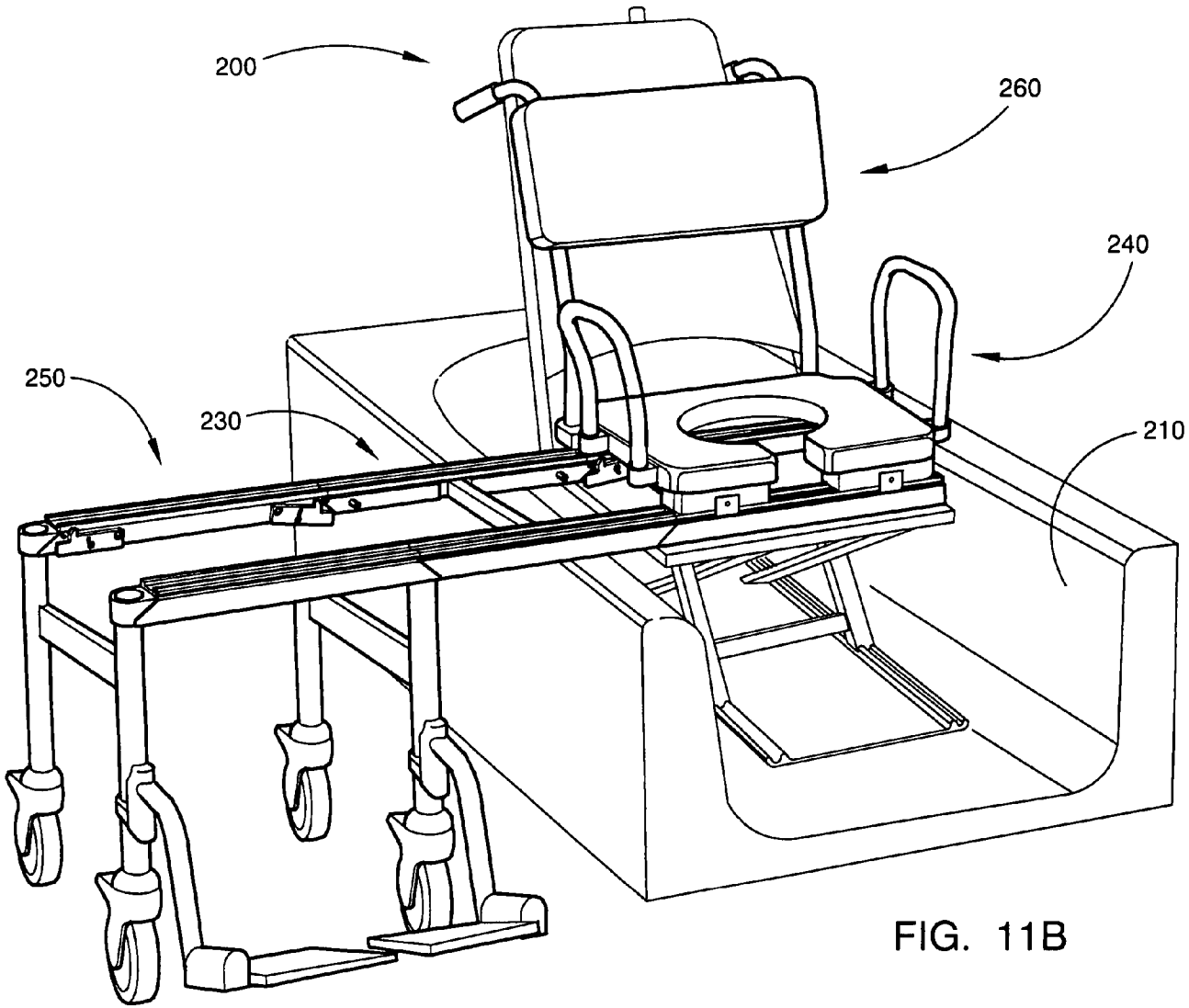
FIG. 11B depicts a perspective view of an alternate embodiment of the bath transfer system with the capability to lower and raise an individual into and out of a bathtub, with the upper portion positioned over the bathtub portion, constructed in accordance with the present invention.

As illustrated in FIG. 11B, there is seen a perspective view of bath transfer system 200, with upper portion 260 positioned over bathtub portion 240.

Figure 11C:
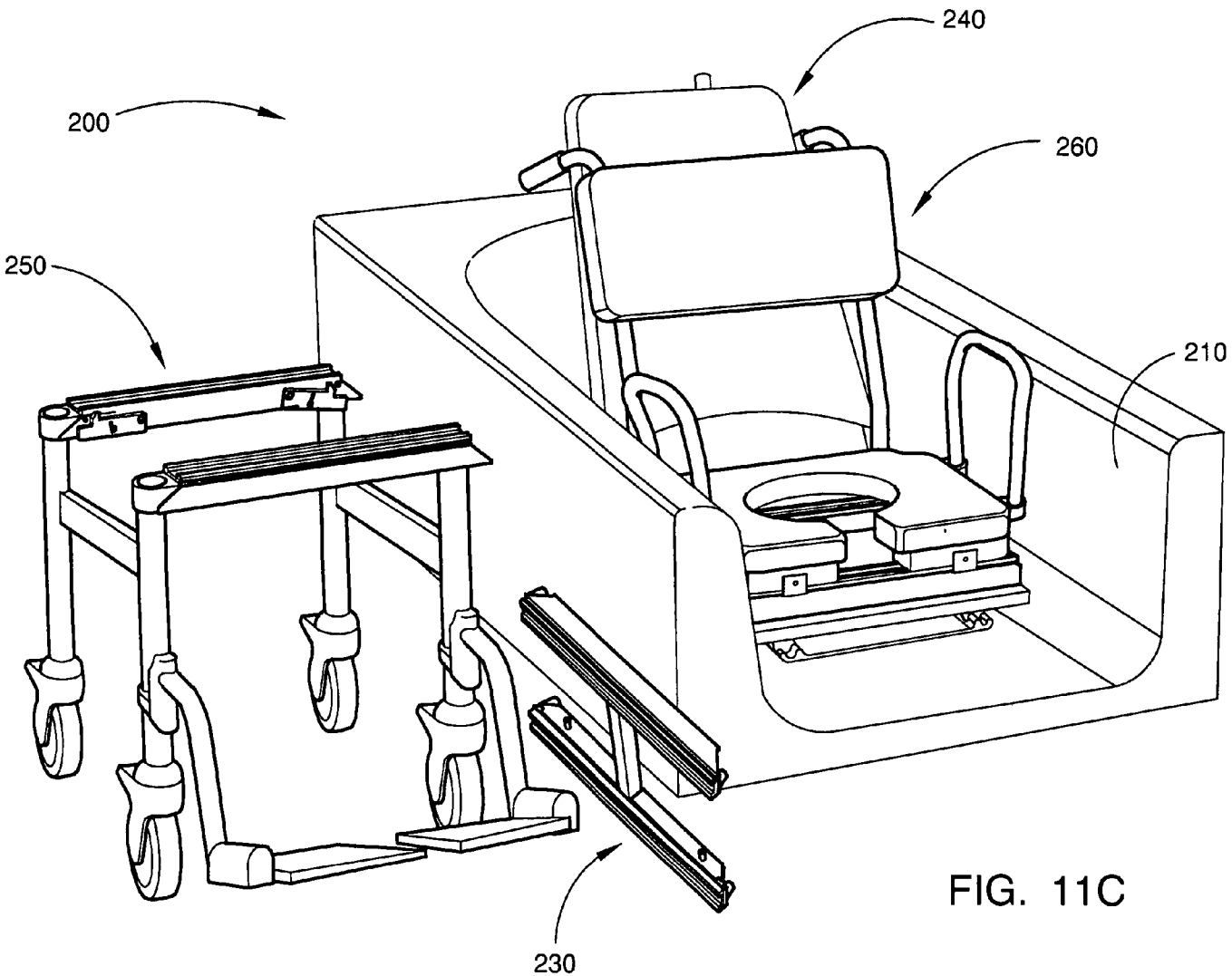
FIG. 11C depicts a perspective view of an alternate embodiment of the bath transfer system with the capability to lower and raise an individual into and out of a bathtub, with the upper portion positioned within the bathtub and the connector bridge portion removed, constructed in accordance with the present invention.

As illustrated in FIG. 11C, there is seen a perspective view of bath transfer system 200, with upper portion 260 positioned within bathtub 210 and connector bridge portion 230 removed. When upper portion 260 is in this position, a user can soak in bathtub 210 with a curtain (not shown) fully enclosed around bathtub 210 to provide maximum privacy.

Bath transfer systems 100 and 200 enable a user who desires to utilize the bathroom facilities to do so without having to transfer apparatus. For illustration purposes, the operation of the bath transfer system will primarily be explained using bath transfer system 100. To use bath transfer system 100, chair portion 30 can be rolled to a bedroom or other location where a user may reside. The user is then seated on chair seat 90, against backrest portion 80, and can place his or her arms on locking arms 72. Manual latch 110 is engaged to prevent the user from sliding off chair portion 30 during transport. The user is then transported into the bathroom where the user can utilize the toilet or sink while remaining within chair portion 30.

If the user desires to take a bath, chair portion 30 can then be positioned adjacent to a bathtub containing bathtub portion 50 located therein. Connector portion 40 can then be attached to chair portion 30 and bathtub portion 50 to provide a bridge for upper chassis 70 to slidably translate over bathtub portion 50. Before a user is positioned over bathtub portion 50, latch slides 47 are engaged with anti-roll latches 100 to prevent connector portion 40 from lifting or separating from bathtub portion 50 or chair portion 30. Additionally, if chair portion 30 is not vertically level with bathtub portion 50, bathtub support members 56 can be adjusted to provide a level and controlled transition. Manual latch 110 can then be released and upper chassis 70 can slidably translate the user along connector portion 40 to be positioned over bathtub portion 50, wherein manual latch 110 can be engaged to prevent further sliding.

Once a user is positioned over bathtub portion 50, connector portion 40 can be removed from bathtub portion 50 and chair portion 30, allowing the bathtub curtain to be closed around the user for privacy during bathing. Further, with regard to bath transfer system 200, a user positioned over bathtub portion 240 can be lowered into a bathtub to allow the user to soak within the bathtub. The user can be lowered within the bathtub via lowering mechanism 300, which is located behind backrest section 280 and can be either an electrical, pneumatic, or hydraulic powered motor or a mechanically operated mechanism such as a hand crank. When a user is finished bathing, the user can then be raised out of the bathtub, dried off, the connector portion can then be reattached, and the user can slidably translate from the bathtub portion over the connector portion and back to the chair portion, wherein the user can then be transported to a different location.

Further, the purpose of the foregoing abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting, as to the scope of the invention in any way.

We claim:

1. A bath transfer system comprising:

a) a chair portion for the purpose of enabling a user to be positioned adjacent to a bathtub, said chair portion containing a base portion and an upper portion, said base portion containing at least two chair portion track members having a continuous groove on one side and at least two chair portion support members attached to said at least two chair portion track members, said upper portion containing an upper chassis, a backrest portion attached to said upper chassis, and a chair seat attached to said upper chassis;

b) a connector portion removably attached on one end to said chair portion, said connector portion containing at least two connector portion track members having a continuous groove on one side;

c) a bathtub portion removably attached to the other end of said connector portion, said bathtub portion containing at least two bathtub track members having a continuous groove on one side and at least two bathtub portion support members attached to said at least two bathtub track members; and d) rolling means attached to said upper chassis for the purpose of allowing said upper chassis to translate along said continuous groove of said at least two chair portion track members, said continuous groove of said at least two connection portion track members, and said continuous groove of said at least two bathtub track members whereby a user can be placed into said chair portion for transport to the bathroom and utilization of the commode, and if the user desires to bathe, the user can be positioned adjacent to a bathtub having said bathtub portion located therein, without having to change apparatus, wherein said connector portion is then attached on one end to said chair portion and on the other end to said bathtub portion, thus creating a continuous track that allows said upper chassis to translate from said chair portion to over said bathtub portion, after which said connector portion can be removed and a curtain can be drawn around the bathtub to allow the user to bathe in privacy.

2. The bath transfer system of claim 1 further comprising at least one armrest attached to said upper chassis.

3. The bath transfer system of claim 1, wherein said chair seat is removably attached to said upper chassis.

4. The bath transfer system of claim 1, wherein said chair portion further contains at least one wheel attached to each of said at least two chair portion support members for the purpose of allowing said chair portion to be rolled along a surface.

5. The bath transfer system of claim 1, wherein said connector portion further contains at least two slide prevention mechanisms coupled to said chair portion track members and said bathtub portion track members for the purpose of preventing said upper chassis from undesired translation along said connector portion.

6. The bath transfer system of claim 5, wherein said connector portion further contains at least two latch slides coupled to said connector portion track members for the purpose of engaging said slide prevention mechanisms to allow said upper chassis to translate along said connector portion.

7. The bath transfer system of claim 1, wherein said connector portion further contains at least two latch slides coupled to each of said connector portion track members for the purpose of allowing a user to lock said connector portion to said chair portion and said bathtub portion to prevent said two or more connector portion track members from lifting and separating from said chair portion and said bathtub portion during use of the bath transfer system.

8. The bath transfer system of claim 1, wherein said at least two bathtub portion support members contain means for height adjustment.

9. The bath transfer system of claim 8, wherein said means for height adjustment allows for both gross and fine height adjustment.

10. The bath transfer system of claim 9, wherein said means for height adjustment comprises an outer tubular member and an inner tubular member disposed within said outer tubular member, said outer tubular member having a plurality of orifices spaced apart for gross height adjustment, said inner tubular member having a helical slot with a plurality of detents positioned therein for fine height adjustment, said inner tubular member housing a spring-loaded plunger, whereby said spring-loaded plunger can be disposed within one of said plurality of orifices for gross height adjustment and a user can rotate said outer tubular member with respect to said inner tubular member to cause said spring-loaded plunger to be positioned within one of said plurality of detents for fine height adjustment.

11. The bath transfer system of claim 1, wherein each of said at least two bathtub portion support members further contain a non-slip surface at the distal ends thereof for the purpose of preventing said bathtub portion from slipping during use.

12. The bath transfer system of claim 1, wherein said bathtub portion further contains lowering means for the purpose of allowing a user to be substantially positioned within the bathtub to soak in the bathtub.

13. The bath transfer system of claim 12, wherein said lowering means comprises a hand crank attached to said bathtub portion.

14. The bath transfer system of claim 12, wherein said lowering means comprises a pneumatic lift attached to said bathtub portion.

15. The bath transfer system of claim 12, wherein said lowering means comprises a hydraulic lift attached to said bathtub portion.

16. The bath transfer system of claim 1 further comprising a manual latch coupled to said upper chassis for the purpose of allowing a user to manually prevent upper chassis from slidably translating along said continuous groove of said at least two chair portion track members, said continuous groove of said at least two connection portion track members, and said continuous groove of said at least two bathtub track members.

17. A bridge for allowing a user to safely and securely slidably translate while in a seat from a position adjacent to a bathtub to a position within a bathtub comprising:

a) at least two track members having a continuous groove on one side for allowing controlled translation of the seat along said at least two track members;

b) at least two slide prevention mechanisms coupled to said at least two track members for the purpose of preventing the seat from undesired translation along the at least two track members;

c) at least one cross member coupled to said at least two track members for the purpose of providing support to said at least two track members; and d) a conical shaped cleat on each end of each of said at least two track members for the purpose of allowing the bridge to securely attach to connecting portions, wherein the weight of the user and seat serves to prevent the bridge from lifting and separating from said connecting portions while the seat is translating along the bridge.

18. A method for making a bath transfer system comprising the steps of:

a) providing a chair portion for the purpose of enabling a user to be positioned adjacent to a bathtub, said chair portion containing a base portion and an upper portion, said base portion containing at least two chair portion track members having a continuous groove on one side and at least two chair portion support members attached to said at least two chair portion track members, said upper portion containing an upper chassis, a backrest portion attached to said upper chassis, a chair seat attached to said upper chassis, and rolling means attached to said upper chassis;

b) providing a connector portion for removable attachment on one end to said chair portion, said connector portion containing at least two connector portion track members having a continuous groove on one side;

c) removably attaching one end of said connector portion to said chair portion;

d) providing a bathtub portion for removable attachment to the other end of said connector portion, said bathtub portion containing at least two bathtub track members having a continuous groove on one side and at least two bathtub portion support members attached to said at least two bathtub track members; and e) removably attaching said bathtub portion to the other end of said connector portion.

19. The method for making a bath transfer system of claim 18, wherein said connector portion further comprises at least two slide prevention mechanisms coupled to said at least two connector portion track members for the purpose of preventing said chair seat from undesired translation along said at least two connector portion track members and at least one cross member coupled to said at least two connector portion track members for the purpose of providing support to said at least two track members.

* * * * *